United States Patent [19]

Schafer et al.

[11] Patent Number: 4,621,516

[45] Date of Patent: Nov. 11, 1986

[54] TRANSFER FEED PRESS WITH TRANSFER FEED SYSTEM

[75] Inventors: Thomas B. Schafer, Riverside; William Sindelar, deceased, late of Darien, by Dorothy Sindelar, legal representative; Joseph R. Cummens, Elmhurst, all of Ill.

[73] Assignee: Avondale Industries, Inc., New York, N.Y.

[21] Appl. No.: 729,535

[22] Filed: May 2, 1985

Related U.S. Application Data

[63] Continuation of Ser. No. 414,674, Sep. 3, 1982.

[51] Int. Cl.[4] ..... B21J 13/08

[52] U.S. Cl. ..... 72/405; 72/422; 198/621

[58] Field of Search ..... 72/405, 421, 422; 198/621; 414/751, 750; 29/563

[56] References Cited

U.S. PATENT DOCUMENTS

| | | | |
|---|---|---|---|
| 3,165,192 | 1/1965 | Wallis | 414/750 |
| 3,456,814 | 7/1969 | Bautz | 198/621 |
| 3,611,770 | 10/1971 | Kralowetz | 72/422 |
| 3,633,766 | 1/1972 | Byam et al. | 72/422 |
| 3,738,503 | 6/1973 | Wallis | 198/621 |
| 3,757,961 | 9/1973 | Jacobs | 72/405 |
| 3,834,213 | 9/1974 | Henzler et al. | 72/421 |
| 4,133,199 | 1/1979 | Shirao | 72/405 |
| 4,272,981 | 6/1981 | Endter | 72/421 |
| 4,416,133 | 11/1983 | Doyle | 72/421 |
| 4,449,390 | 5/1984 | Pontini | 72/422 |
| 4,462,521 | 7/1984 | Takagi | 198/621 |

FOREIGN PATENT DOCUMENTS

| | | | |
|---|---|---|---|
| 2455931 | 1/1981 | France | 72/422 |
| 175803 | 1/1966 | U.S.S.R. | 72/405 |

OTHER PUBLICATIONS

Danly Transfer Feed Press (brochure), Danly Machine Corporation, Chicago, Illinois, pp. 1–8, 1968.

*Primary Examiner*—Daniel C. Crane

*Attorney, Agent, or Firm*—Leydig, Voit & Mayer

[57] ABSTRACT

A transfer feed press for performing a series of press operations on a workpiece at a series of work stations where a plurality of finger units spaced along the work stations for gripping the workpieces move the same between successive work stations in the press. Servo motors, in association with the appropriate gearing, transfer the finger units along the X, Y, Z axes for positioning the workpieces at successive work stations. Separate servo motors are adapted to rotate a workpiece, gripped by the finger units, 180°, for performing press operations on both sides of the workpiece.

2 Claims, 15 Drawing Figures

TRANSFER FEED PRESS WITH TRANSFER FEED SYSTEM

This is a continuation of application Ser. No. 414,674, filed Sept. 3, 1982.

FIELD OF THE INVENTION

The invention relates generally to a transfer feed press which is used for performing various metal working operations, such as blanking or drawing metal parts. More particularly, the invention relates to an apparatus for automatically moving various workpieces from one press operation to another within a transfer feed press.

BACKGROUND OF THE INVENTION

In the metal working industry there are a large number of transfer feed presses which vary in size and output depending upon a manufacturer's specific needs. The larger presses, for example, may have a capacity of approximately 600 tons to 3000 tons with a stroke rate of perhaps 15 to 30 press strokes per minute. Such a transfer feed press is capable of a wide range of press operations which virtually eliminate the requirement of using several presses to manufacture a part. The cost efficiency of using a large transfer feed press increases dramatically with an increase in the number of parts to be produced during a specific production run. Moreover, the cost efficiency is also increased when a single transfer feed press can perform most or all of the press operations without transferring the workpieces to multiple presses. For these reasons, it is essential that a transfer feed press be able to move the workpieces in the press to the various die stations rapidly, accurately and efficiently.

Once the workpiece is mounted in a finger unit in transfer feed press, it may be moved any number of times to align it with the various die stations in the press. As an example, a workpiece may have to be rotated 180° for a piercing operation, then rotated back 180° for a trimming operation, or some other press operation. This procedure may occur any number of times before the part is transformed into a finished product. A workpiece such as an automotive suspension arm may be transferred between blank, draw, restrike, trim and pierce, flange and coin, cam pierce, and cam extrude stations in a typical sequence of steps performed by a transfer feed press. Regardless of the number of operations performed, the workpieces must be positioned rapidly and accurately in a cost efficient manner.

SUMMARY OF THE INVENTION

In accordance with the present invention, a transfer feed press is provided with a transfer feed system comprising the combination of a plurality of finger units spaced along said work stations for gripping the workpieces and moving the same between successive work stations in the press, means mounting the finger units for independently controllable movement along (1) a longitudinal axis defining the direction of workpiece movement through the successive work stations of the press, (2) a transverse axis defining the direction of movement of the finger units in and out of engagement with the workpieces at the various work stations, and (3) a vertical axis defining the direction of vertical movement of the finger units for raising and lowering the workpieces at the various work stations of the press, and a separate electric servo motor for controlling movement of said finger units along each of the axes, each of the servo motors being independently controlled by electrical control signals. In addition, each finger unit may rotate a workpiece 180° to allow a press operation to occur on either side of a workpiece.

OBJECTS OF THE INVENTION

It is a primary object of the present invention to provide a transfer feed press having an improved workpiece transfer system which uses a small number of electric servo motors to consistently, accurately and reliably move a plurality of workpieces from one press operation to another during high speed production runs.

A further object of this invention is to provide such an improved workpiece transfer system which is both economical to manufacture and efficient to operate and maintain.

Another object of one particular aspect of the invention is to provide such an improved workpiece transfer system which minimizes the power requirements on the electric servo motors.

Another particular object of the invention is to provide such an improved workpiece transfer system which ensures a "soft" stop in the event of overtravel of the workpiece-gripping finger units due to inertia or the like.

Other objects and advantages of the invention will become apparent upon reading the attached detailed description and upon reference to the drawings, in which:

While the invention will be described with reference to certain preferred embodiments, it will be understood that we do not intend to be limited to the embodiments shown, but intend, on the contrary, to cover the various alternative forms of the invention included within the spirit and scope of the appended claims.

DETAILED DESCRIPTION OF THE INVENTION

Figure 3:
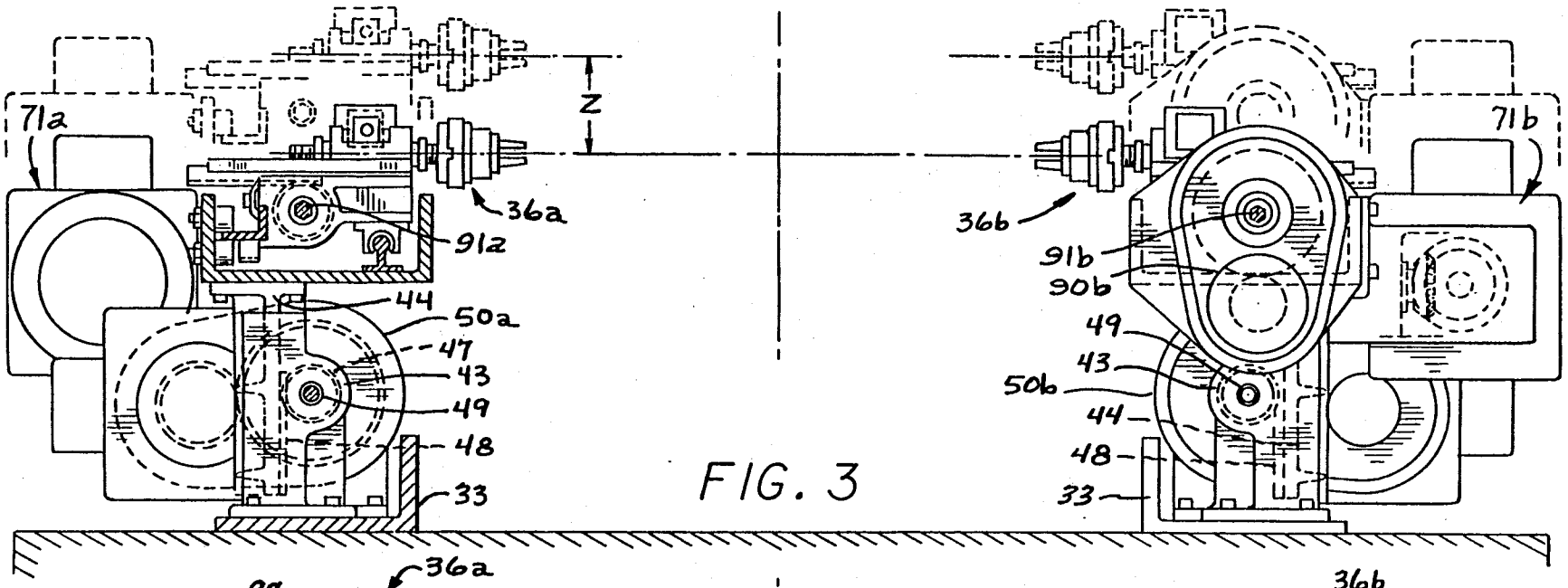
FIG. 3 is a partial cross sectional view taken along line 3—3 in FIG. 1 showing a transfer feed line which includes a finger unit shown in phantom lines after it has been elevated in the Z axis direction.
Figure 4:
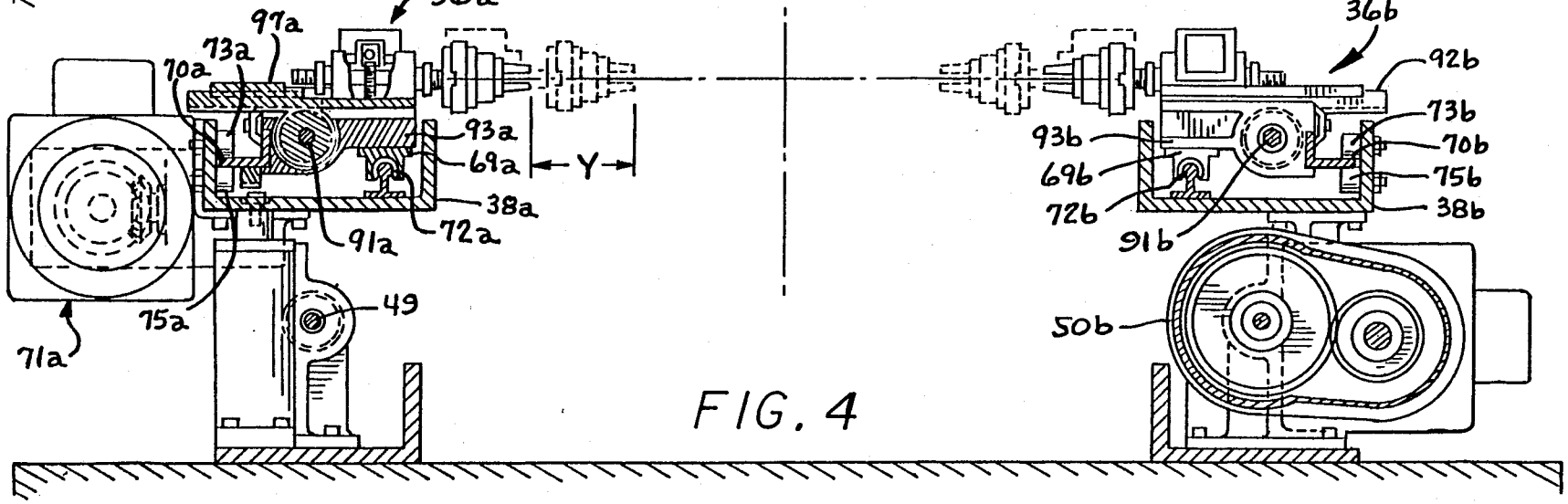
FIG. 4 is a partial cross sectional view taken along line 4—4 in FIG. 1 showing the transfer feed line with a finger unit in phantom lines moving in the Y axis direction.
Figure 5:
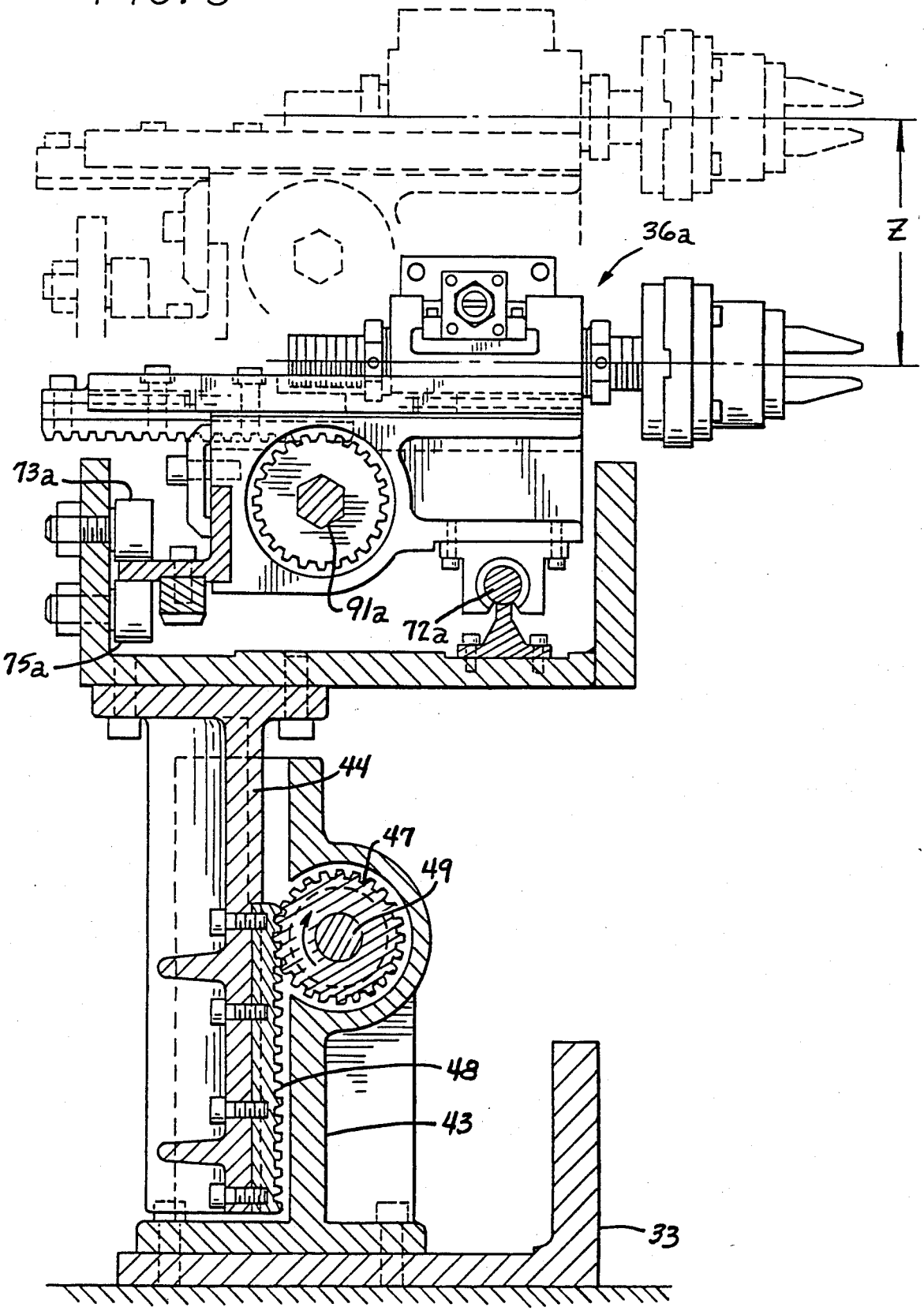
FIG. 5 is a cross sectional view taken along line 5—5 in FIG. 1 showing the lift column assembly and the rack and pinion arrangement for moving the transfer feed rail in the Z axis direction.

Before describing the various aspects of the invention, several definitions are in order. The X axis runs parallel to the longitudinal axis of the transfer feed line and is clearly depicted in FIG. 1. The Y axis is defined by the path of movement of each finger unit as it travels back and forth in a direction transverse to the longitudinal axis of the transfer feed line (see FIGS. 1 and 4). The Z axis is the direction of vertical movement of the finger units perpendicular to the longitudinal axis of the transfer feed line, and is shown in FIG. 3.

Figure 1:
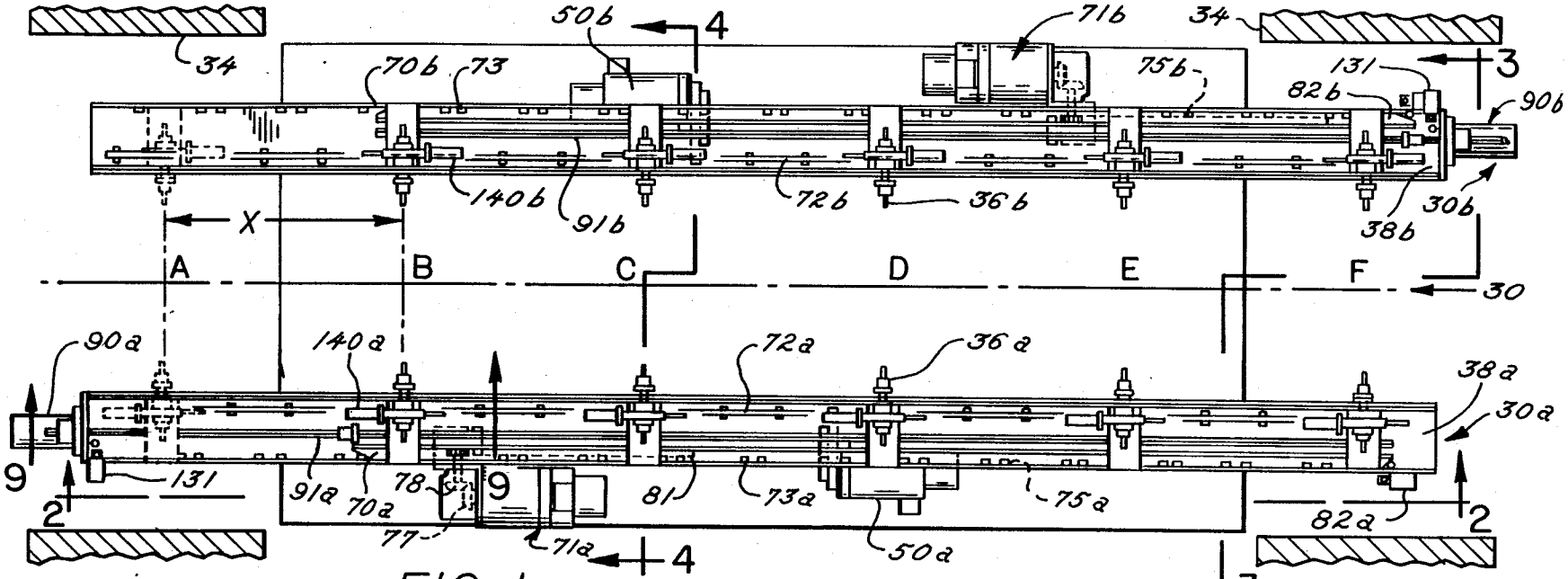
FIG. 1 is a plan view of a transfer feed line extending along the longitudinal axis of a transfer feed press (not shown)
Figure 2:
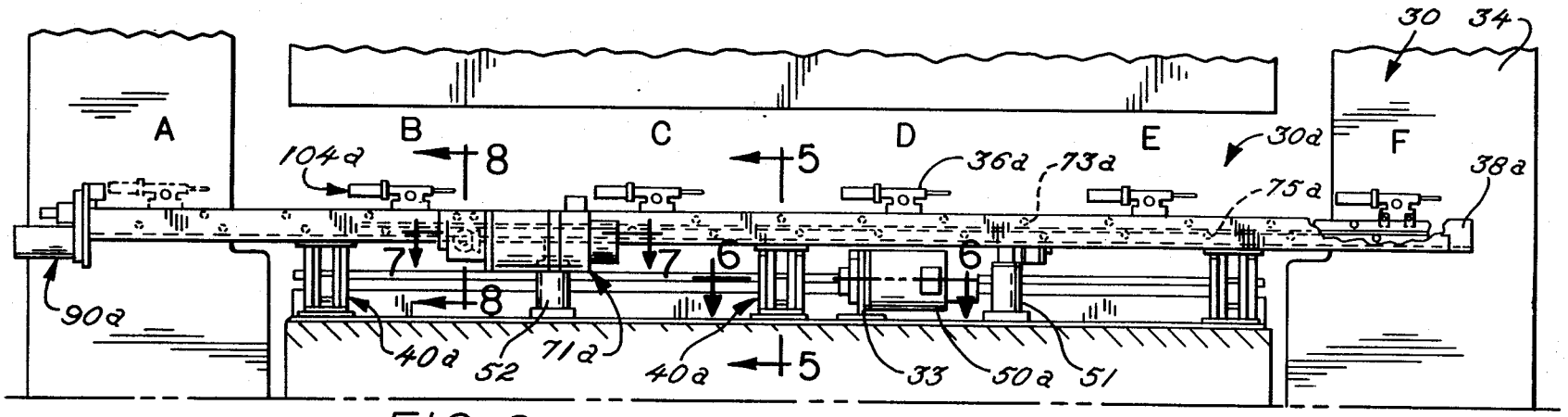
FIG. 2 is an elevational view taken along line 2—2 in FIG. 1 showing a transfer feed rail along the longitudinal axis as it is supported on the bed.

In the drawings there is shown a transfer feed line 30 comprising two transfer feed rails 30*a* and 30*b* which are parallel to each other and spaced a predetermined distance apart. The transfer feed rails 30*a* and 30*b* extend along the longitudinal axis of a transfer feed press having a series of successive work stations A, B, C, D, E and F. FIGS. 1 and 2 show fragments of the vertical support columns 34 of the press and the press slide 35 which is positioned directly over the work stations A-F. The primary purpose of the transfer feed line 30 is to present workpieces to the different work stations A-F of the transfer feed press in a rapid and accurate manner. The two rails 30*a*, 30*b* move simultaneously and in synchronization with each other so that for each work station a single workpiece will be positioned and worked on.

For the purpose of transferring workpieces from one work station to the next, each of the rails 30*a* and 30*b* is equipped with a number of finger units 36*a* and 36*b* adapted to grip a workpiece and transfer it between work stations. Each finger unit 36*a* and 36*b* is mounted atop a transfer rail 38*a* or 38*b* which in turn is securely fastened to multiple lift column assemblies to be discussed below. During operation, the transfer rails 38*a* and 38*b* ove along with the finger units 36*a* and 36*b* when the finger units are moved along the Z axis; however, the transfer rails do not move with the finger units along either the X or the Y axes.

Figure 6:
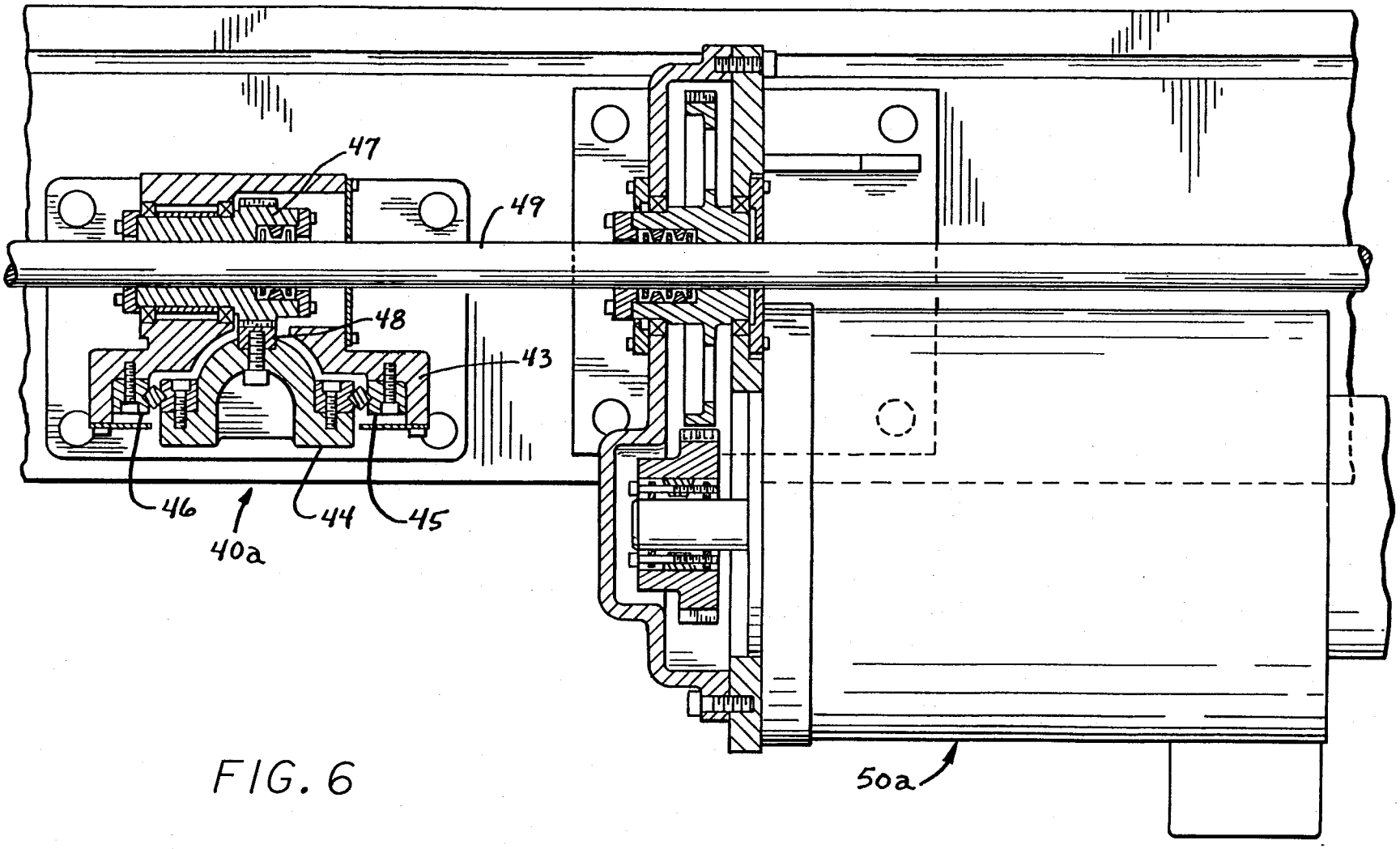
FIG. 6 is a partial cross sectional view taken substantially along line 6—6 in FIG. 2 depicting the lift column assembly and lift column servo motor used for moving the transfer feed rail in the Z axis direction.
Figure 7:
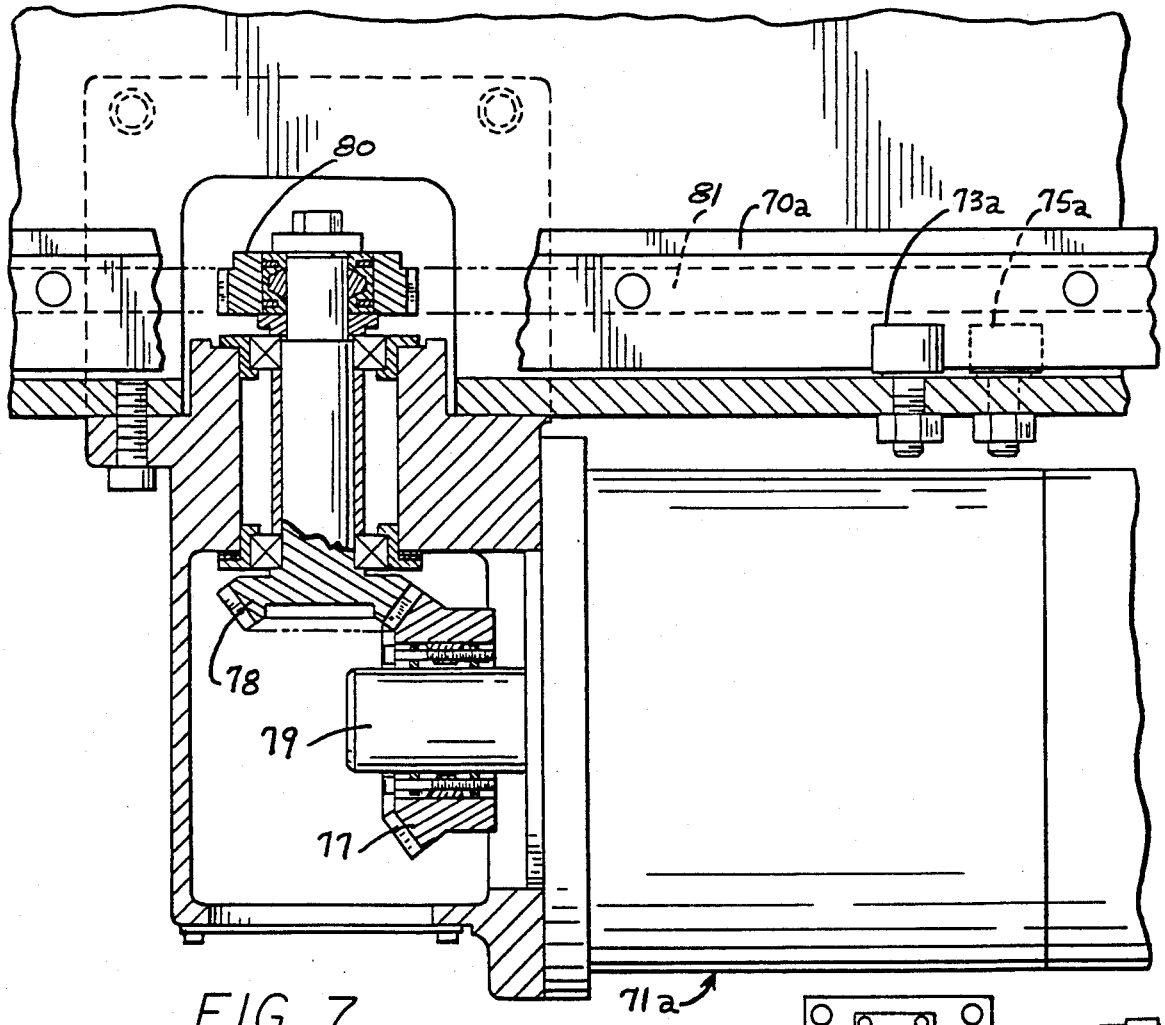
FIG. 7 is a partial cross sectional view taken along line 7—7 in FIG. 2 depicting the transfer drive servo motor and accompanying beveled gear assembly for moving the finger unit assemblies in the X axis direction.
Figure 8:
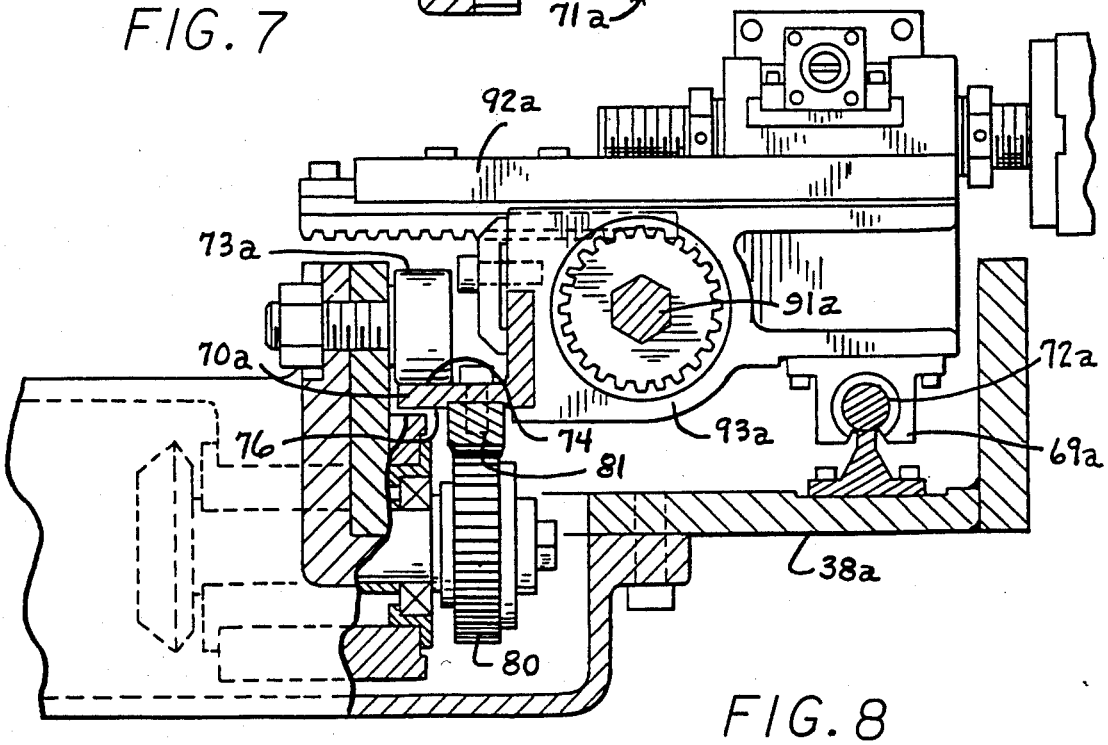
FIG. 8 is a cross sectional view taken substantially along line 8—8 in FIG. 2 which depicts the rack and pinion assembly for moving the finger units in the X axis direction.
Figures 9, 15:
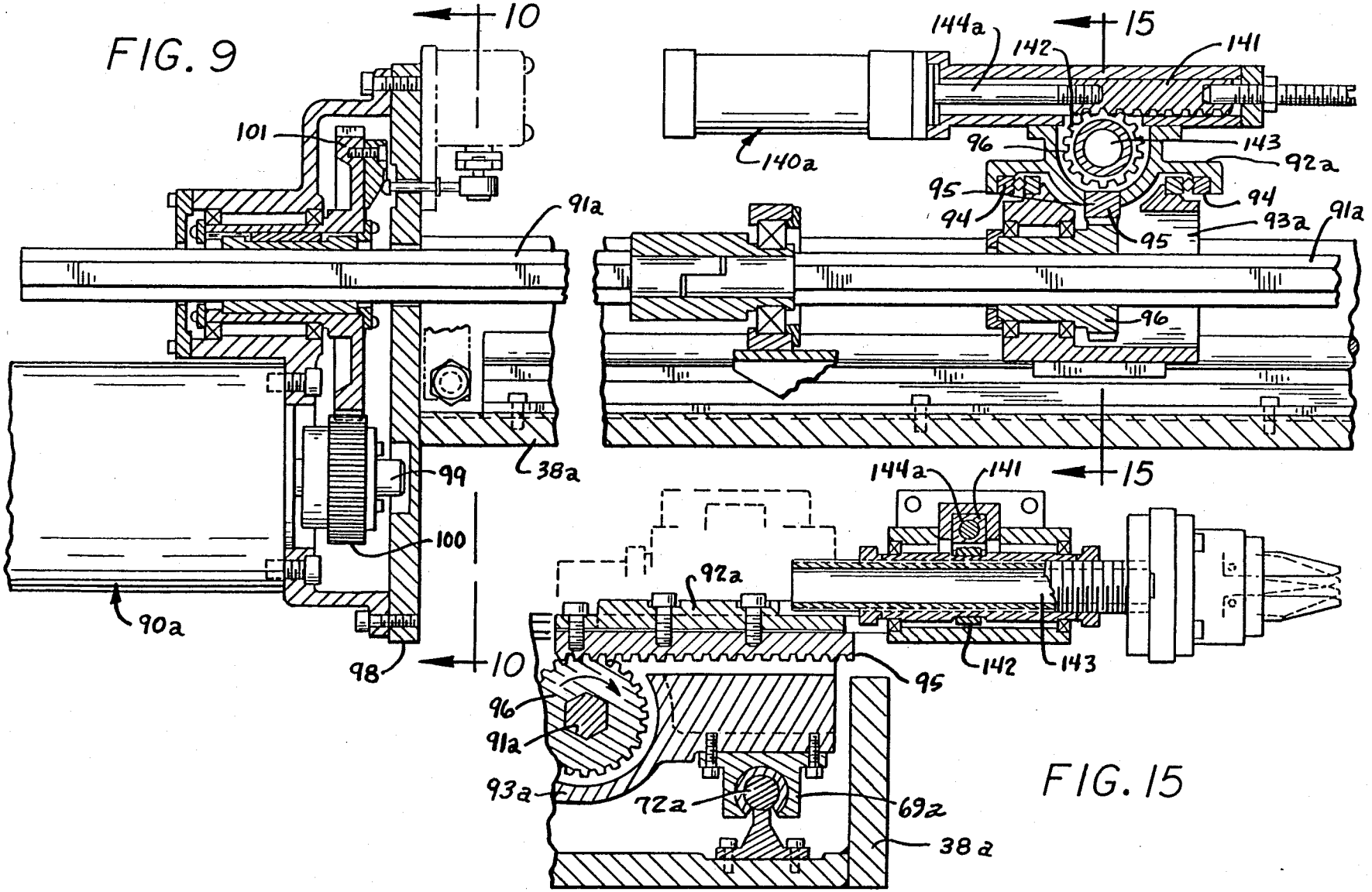
FIG. 9 is a partial cross sectional view taken along line 9—9 in FIG. 1 which depicts the drive motor and gear assembly for transferring the finger station assemblies in the Y axis direction.
FIG. 15 is a cross sectional view taken along line 15—15 in FIG. 9 depicting the finger station shaft and its associated gearing.
Figure 10:
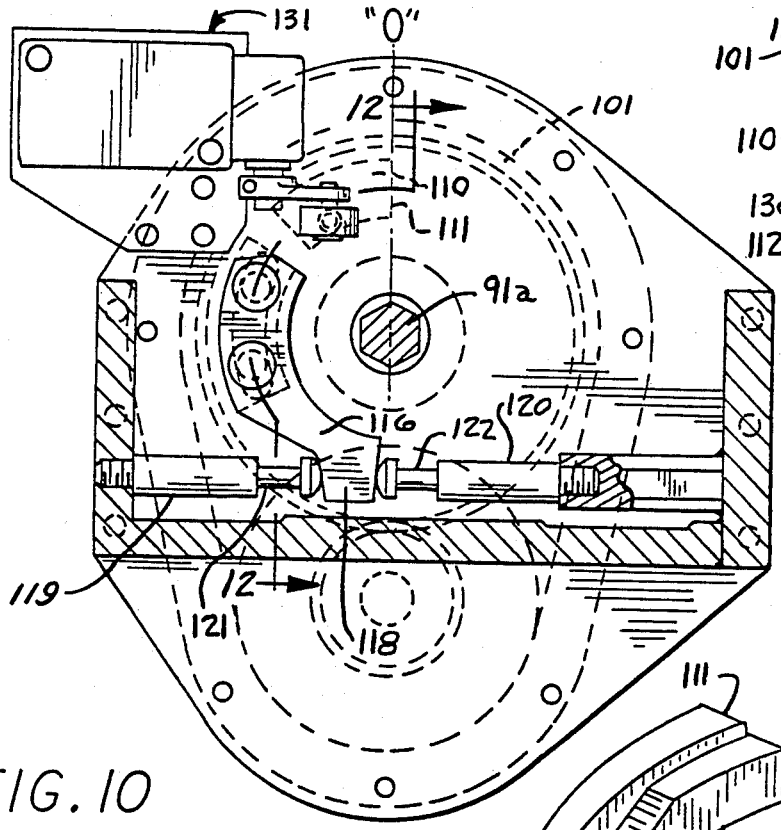
FIG. 10 is a partial cross sectional view taken along line 10—10 in FIG. 9 and shows the cam and limit switch for finding the "0" home position.

For movement of the finger units 36*a*, 36*b* along the Z axis, which will raise or lower the workpieces relative to the work stations, two series of lift column assemblies 40*a* and 40*b* cooperate wit respective electric servo motors 50*a* and 50*b* to raise and lower the corresponding transfer rails 38*a*, 38*b*. Each lift column assembly 40*a* or 40*b* is comprised of two sections, a stationary column 43 fixed to the base rail 33 and a movable lifting column 44 mounted for sliding movement up and down along the stationary column 43. More particularly, the movable column 44 rides on a pair of linear bearings 45, 46 which fit into complementary grooves in the opposed surfaces of the two columns 43, 44 (see FIG. 6).

The electric servo motor 50*a* or 50*b* drives the movable column 44 through a pinion 47 and rack 48 which convert the rotational output of the servo motor into linear motion which will raise or lower the columns 44 and the transfer rail 38*a* or 38*b* mounted thereon. Because there is only one servo motor 50*a* and 50*b* for the Z axis of each of the transfer feed rails 30*a* and 30*b*, the shaft 49 upon which the pinions 47 are mounted extends along the longitudinal axis of the transfer feed line 30 and acts as a common shaft for each of the three lift column assemblies 40*a*, 40*b* associated with each rail.

The weight of each transfer feed rail 30*a* and 30*b*, absent the workpieces, is counterbalanced by a pair of pneumatic cylinders 51 and 52 which are fixed to the base rail 33. These cylinders 51, 52 are manually adjusted so that their upward force approximately equals the weight of the corresponding rail assembly 30*a* or 30*b*, so that the only power that needs to be supplied by the servo motors 50*a* and 50*b* is the power required to lift the workpieces.

There may be a tendency for the servo motors 50*a* or 50*b* to continue moving the transfer feed rails 30*a* or 30*b* in a vertical direction past the predetermined stopping point, due, for example, to inertia of the gears. In order to generate an electrical reference signal when the transfer feed rails 30*a* and 30*b* reach the upper or lower limit of vertical travel, a limit switch 53 is mounted on the underside of rails 38*a* and 38*b* and is activated when its trip arm engages column 51.

In order to move the finger units along the X axis to advance the workpieces between successive work stations, the two rows of finger units 36*a* and 36*b* are mounted on respective drive rails 70*a* and 70*b* which are driven back and forth along the X axis by a pair of electric servo motors 71*a* and 71*b*. The drive rails 70*a*, 70*b* are fastened to the lower housing sections 93*a*, 93*b* of the finger units 36*a*, 36*b*, while lower housing sections 93*a*, 93*b* carries pillow blocks 69*a*, 69*b* which ride on one of a pair of parallel support rails 72*a* and 72*b* which extend continuously along the top surfaces of the transfer rails 38*a*, 38*b*. Each drive rail 70*a*, 70*b* is supported for smooth sliding movement by two series of roller bearings mounted on the outboard wall of each transfer rail; the upper bearings 73*a* and 73*b* ride on the upper surface 74 of the drive rail, and the lower bearings 75*a* and 75*b* ride on the lower surface 76.

To connect the servo motors 71*a*, 71*b* to the drive rails 70*a*, 70*b*, a pair of bevel gears 77, 78 connect each motor output shaft 79 to a pinion 80 meshing with a rack 81 fastened to the underside of the drive rail. As is apparent in the drawings, there must be an opening in each transfer rail 38*a* and 38*b* through which the shaft of one of the bevel gears extends in order to cooperate with the drive rails 70*a* and 70*b*. The length of the rack 81 is sufficient to reciprocate the drive rail 70*a* or 70*b* over a stroke length that is at least as great as the distance between a pair of adjacent work stations. The servo motors 71*a* and 72*b* are mounted on the respective transfer rails 38*a*, 38*b* so that the servo motors are carried along with the transfer rails whenever they are raised or lowered by the servo motors 50*a*, 50*b*. Thus, the servo motors 71*a*, 71*b* can be moving the finger units along the X axis simultaneously with the raising or lowering of such units by the servo motors 50*a*, 50*b*.

If the drive rails 70*a* or 70*b* travel longitudinally beyond a safe predetermined stopping point, limit switches 82*a*, 82*b* relay an electrical reference signal to servo motors 71*a* or 71*b* respectively, to prevent further movement. The switches 82*a*, 82*b* are mounted on the transfer rails 38*a* and 38*b* (FIG. 1) for engagement with the drive rail 70*a*, 70*b* as it overtravels to the right.

To move the finger units along the Y axis for engaging and disengaging the workpieces at the various work stations, the upper section of each finger unit is mounted for transverse movement along the Y axis in response to rotation of one of a pair of drive shafts 91*a* and 91*b* driven by electric servo motors 90*a* and 90*b*, respectively. Thus, the housing of each finger unit comprises upper housing sections 92*a*, 92*b* carrying the gripping fingers and lower housing sections 93*a*, 93*b* secured to the drive rail 70*a* and 70*b* and carrying the linear bearing 94. These two housing sections 92*a*, 92*b* and 93*a*, 93*b* are separated by the linear bearing 94 which permits sliding movement of the upper housing sections 92*a*, 92*b* over the lower sections 93*a*, 93*b* in the transverse or Y axis direction.

Sliding movement of the upper housing sections 93*a*, 93*b* is effected by moving a rack 95 fastened to the underside of the upper housing sections 92*a*, 92*b* for engagement with a pinion 96 fixed to the drive shaft 91*a* or 91*b*. Thus, as the drive shaft 91*a* and 91*b* is rotated, it turns the pinion 96 which in turn moves the rack 95 and thus the upper housing sections 92*a*, 92*b* relative to the lower sections 93*a*, 93*b*. This sliding movement advances and retracts the gripping fingers along the Y axis for engaging and disengaging the workpieces located at the various work stations.

Rotation of the drive shafts 91*a* and 91*b* is effected by the respective servo motors 90*a*, 90*b* mounted on housing plate 98*a*, 98*b* on the ends of the corresponding transfer rails 38*a* and 38*b*. Each motor 90*a*, 90*b* is offset from the axis of its drive shaft 91*a* or 91*b*, with the output shaft 99 of the motor being coupled to the drive shaft 91*a* or 91*b* via a pair of gears 100 and 101. In the particular embodiment illustrated, a single servo motor 90*a* or 90*b* is provided for all the finger units one side of the press work stations, i.e., all the finger units carried by the same transfer rail 38*a* are driven in synchronism with each other by a common drive shaft 91*a* or 91*b* driven by a single servo motor 90*a*, 90*b*. As an alternative, however, a separate servo motor and drive shaft could be provided for each separate finger unit, or for different sub-groups of finger units on the same transfer rail.

Figure 12:
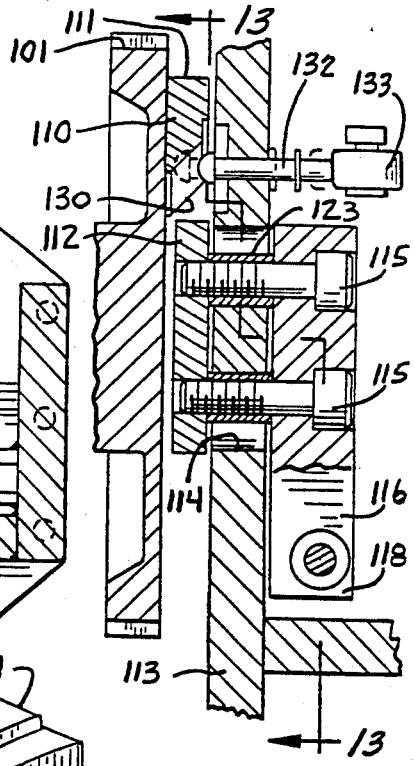
FIG. 12 is a cross sectional view taken along line 12—12 in FIG. 10 depicting the cam and plunger used to find the "0" home position.
Figure 11:
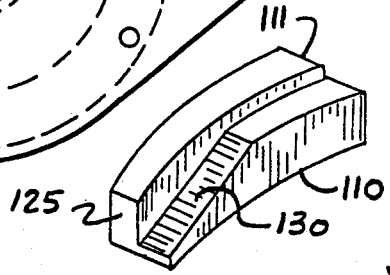
FIG. 11 is an enlarged perspective view showing the sloped cam surface of the stop plate.

To allow for a certain amount of overtravel of the Y-axis drive system while at the same time ensuring a soft stop at the end of such overtravel, the illustrative system includes an overtravel soft-stop mechanism in the Y-axis drive train as shown in FIGS. 10–14. Thus, the drive gear 101 at the end of the drive shaft 91*a* carries an arcuate stop plate 110 which in the fully retracted "home" position of the finger units driven thereby is located in the position shown in FIG. 10. It will be noted that in this position the leading edge 111 of the stop plate 110 is in a top dead center position, which will be referred to herein as the 0° position. As shown in FIG. 12, stop plate 110 is fixed to gear 101.

As drive gear 101 rotates in a clockwise direction during advancing movement of the finger units toward the work stations of the press, the leading edge 111 of the stop plate 110 moves from its 0° position to a 230° position over the full stroke of the desired range of travel of the finger units. In an actual press, this 230° of travel typically represents 4 inches of linear movement of the finger units along the Y axis. If the drive system travels beyond the 230° position (e.g., due to inertia), it moves freely for an additional 12.5° to the 242.5° position, which in many situations will be a sufficient range of overtravel to permit the Y-axis drive system to come to a complete stop.

If, however, the overtravel continues beyond the 242.5° position, the leading edge 111 of the stop plate 110 engages a second stop plate 112 mounted on the rigid end plate 113. As can be seen most clearly in FIG. 13, this second stop plate 112 is mounted for limited movement within an arcuate slot 114 formed in the end plate 113. More specifically, the second stop plate 112 is normally held in a centered position relative to the slot 114 by a pair of bolts 115 which extend through the slot 114 and interconnect the stop member 112 on one side of the plate 113 with a trip plate 116 on the other side of the plate 113. The lower end 118 of the trip plate 116 extends downwardly between a pair of fluid controlled shock absorbers 119 and 120 whose piston rods 121 and 122 are biased against opposite sides of the depending end portion 118 of the trip lever 116. The opposing forces exerted on the trip lever 116 by the two shock absorbers 119 and 120 tend to hold the trip lever 116 in a position which centers the two connecting bolts 115 within the arcuate slot 114. The exposed portions of the bolts 115 within the slot 114 are surrounded by spacer sleeves 123.

Figure 13:
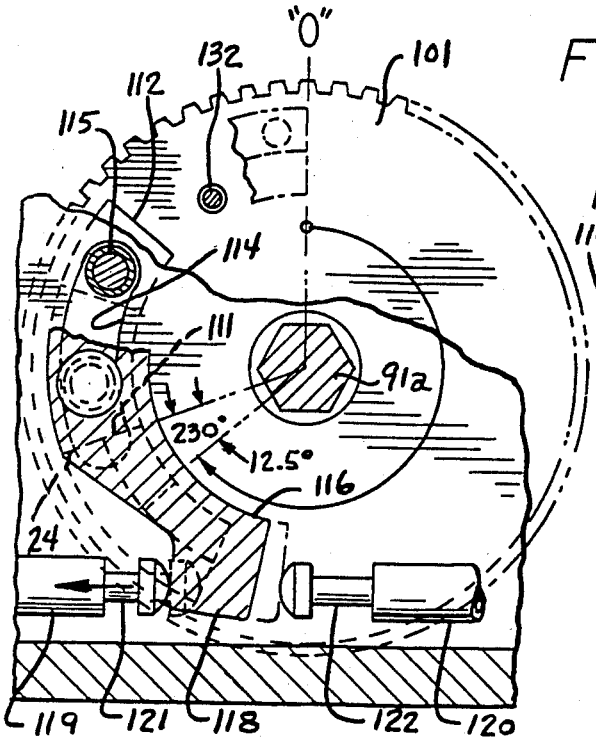
FIG. 13 is a partial cross sectional view taken along line 13—13 in FIG. 12 depicting the shock absorbing system for reducing the shock of gear overtravel in the clockwise direction.
Figure 14:
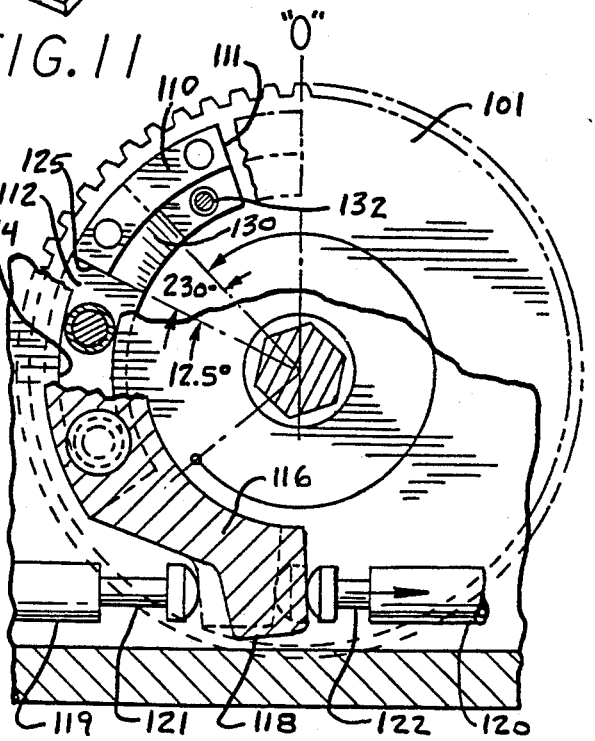
FIG. 14 is a partial cross sectional view similar to FIG. 13 showing the shock absorbing system for providing a soft stop in the event of overtravel in the Y axis direction.

If the leading edge 111 of the stop plate 110 overtravels to the 242.5° position, the edge 111 engages the lower edge 124 of the second stop member 112 (see FIG. 13). Any further advancing movement of the Y-axis drive train must then overcome the resisting force applied thereto by the internal fluid pressure of the shock absorber 119 as lower end 118 of the trip lever 116 engages shock absorber 119. Advancing overtravel can continue within the confines of the arcuate slot 114, i.e., until the spacer sleeve around the upper bolt 115 engages the upper end of the slot 114, as illustrated in FIG. 13. During this additional increment of overtravel, which covers a span of 7½° in the illustrative embodiment, the rate of movement will be rapidly decelerated at an increasing rate because of the resisting force offered by the shock absorber 119. Consequently, the Y-axis drive train will be brought to a smooth and "soft" stop.

During retracting movement of the finger units along the Y axis, the operation of the "soft-stop" mechanism operates in essentially the same manner in response to overtravel of the finger units past their "home" position. Such overtravel during the retracting stroke of the finger units causes the stop plate to move past the 0° position in the counterclockwise direction as viewed in FIGS. 10 and 14. Here again, the stop plate 110 moves freely during the first 12½° of overtravel, after which the "trailing" edge 125 (which is actually the leading edge 111 of the stop plate 110 during retracting movement) of the stop plate 110 engages the upper end of the second stop member 112. Continued counterclockwise movement of the stop plate 110 after it engages the second stop member 112 advances the trip arm 116 in the counterclockwise direction, within the confines of the arcuate slot 114, against the biasing force of the shock absorber 120. This applies an increasing resistive force to any continued overtravel of the gear 101 and its stop plate 110, thereby rapidly decelerating the Y-axis drive train to a "soft" stop.

In order to generate an electrical reference signal each time the finger units reach their "home" position along the Y axis, a cam surface 130 is formed on the stop plate 110 for actuating a limit switch 131. More specifically, the limit switch 131 is actuated by an actuating rod 132 which extends through an aperture in the plate 113. The right-hand end of the rod 132 (as viewed in FIG. 12) engages the actuator 133 of the switch 131, with the internal spring bias of the switch urging the actuator 133 and the rod 132 toward the gear 101. Thus, the rod 132 is normally biased to its left-hand position, shown in broken lines in FIG. 12, and moves to its right-hand position only when engaged by the cam surface 130. Each time the stop plate 110 is returned to its 0° "home" position, the rod 132 is moved far enough to the right by the cam surface to actuate the switch 131, thereby providing a reference signal for the electrical control system which controls the Y-axis servo motor 90*a*, 90*b*.

It may be desirable at certain press stations to perform the press operation on the opposite side of a workpiece; therefore a means is provided for rotating a workpiece 180° so that the press operations can be performed on either side of the workpiece. To accomplish this, air cylinder motors 140*a* and 140*b* cooperate with a rack 141 and pinion 142 to rotate the shaft 143 upon which the workpieces are mounted.

The rack 141 is mounted for reciprocating motion which is provided when the air cylinder motors 140*a* and 140*b* drive a piston rod 144 which is fixed to the rack 141. As the rack 141 is moved, its linear motion is converted to rotational motion by the pinion 142 thereby imparting rotational movement to the finger unit shaft 143 which carries the workpiece. The assembly is capable of rotating the workpiece 180° clockwise or counterclockwise depending upon the initial position of the rack 141 relative to pinion 142, and then by reversing the motion of the rack 141 the workpiece can be rotated back 180° to its original position.

During operation, the improved transfer feed line, using a small number of electric servo motors, will transfer a plurality of workpieces accurately and reliably from one press operation to another during high speed production runs. A plurality of finger units, which grip workpieces, move in unison when transferring the workpieces from one die station to successive die stations. Because only a few servo motors are required to effectuate the positioning of the finger units at successive die stations, the transfer system is both economical and efficient to operate. Moreover, the system incorporates limit switches to prevent damage to machine parts in the event that a servo motor fails to stop at a predetermined point.

What is claimed is:

1. In a transfer feed press for performing a series of press operations on a workpiece at a series of work stations, a transfer feed system for moving a workpiece along a longitudinal direction through successive work stations comprising the combination of a first and second transfer feed rail extending longitudinally along opposite sides of said series of work stations, a row of finger units mounted on each of said transfer feed rails and spaced along said work stations for gripping said workpiece and moving the same between successive work stations in the press, means mounting each row of said finger units for independently controllable movement relative to the transfer feed rail on which the finger units are mounted, along (1) a longitudinal axis defining the direction of workpiece movement through the successive work stations of the press, and (2) a transverse axis defining the direction of movement of the finger units in and out of engagement with the workpieces at the various work stations, means mounting each of said transfer feed rails for independently controllable movement along a vertical axis defining the direction of vertical movement of said finger units for raising and lowering the workpieces at the various work stations of the press, three separate electric servomotors for controlling movement of the first transfer feed rail and the row of finger units thereon along each of said longitudinal, transverse and vertical axes, each of said servomotors being independently controllable by electric control signals, three separate electric servomotors for controlling movement of the second transfer feed rail and the row of finger units thereon along each of said longitudinal, transverse and vertical axes, each of said servomotors being independently controllable by electrical control signals, each of said transfer feed rails carrying the servomotors for controlling movement of the finger units mounted thereon along said transverse and longitudinal axes so that said units can be moved simultaneously along said vertical, transverse and longitudinal axes and each means mounting said transfer feed rails carrying in a stationary position an electric servomotor for controlling vertical movement of each transfer feed rail.

2. A transfer feed press as set forth in claim 1 which includes a separate electric servomotor for controllably rotating each of said finger units about said transverse axes to permit workpieces gripped by said finger units to be rotated about said other axes, said servomotors being mounted on the finger units so that the finger units can be rotated simultaneously with the movement thereof along said other axes.

* * * * *